US005172578A

United States Patent [19]

Bitzios

[11] Patent Number: 5,172,578

[45] Date of Patent: Dec. 22, 1992

[54] LOCKSMITH TOOL

[76] Inventor: Spiridon A. Bitzios, Kartall 11, Ioannina, Greece

[21] Appl. No.: 785,240

[22] Filed: Nov. 1, 1991

Related U.S. Application Data

[63] Continuation of Ser. No. 600,829, Oct. 22, 1990, abandoned.

[30] Foreign Application Priority Data

Feb. 1, 1990 [GR] Greece ..... 900100055

[51] Int. Cl.[5] ..... E05B 19/20

[52] U.S. Cl. ..... 70/394; 33/540; 70/395; 70/398

[58] Field of Search ..... 70/394, 395, 398; 33/539, 540

[56] References Cited

U.S. PATENT DOCUMENTS

| | | | |
|---|---|---|---|
| 3,827,151 | 8/1974 | Nail | 70/394 X |
| 4,120,184 | 10/1978 | Gerlach | 70/395 X |
| 4,185,482 | 1/1980 | Nail | 70/394 |
| 4,535,546 | 8/1985 | Smith | 33/540 |
| 4,667,494 | 5/1987 | Joosten | 33/540 X |

FOREIGN PATENT DOCUMENTS

| | | | |
|---|---|---|---|
| 0049199 | 4/1977 | Japan | 70/394 |
| 0051298 | 4/1977 | Japan | 70/394 |

*Primary Examiner*—Lloyd A. Gall

[57] ABSTRACT

An apparatus for determining lengths of locking elements in locks including a key head and wires maintained on the key head and extendable into the lock cylinder for measuring lengths of the lock pins. The distance that the wires will go into the depth of lock can be used to determine the depth of the furrows or the cuts of the needed key. The advantage of this invention is that one can duplicate a key which has been lost, without damaging the lock, or moving it out of the door. In addition to that this mechanism is also used as a "lock-picker" in order that one can lock or unlock a door when the keys have been lost. The invention operates in two different ways and for two different purposes. The first one is to duplicate a key which has been lost. The second one is to lock or unlock a door for different reasons, e.g. when the key has been lost, or when it is still inside the car or the house while the door is still locked.

5 Claims, 5 Drawing Sheets

LOCKSMITH TOOL

This is a continuation of application Ser. No. 07/600,829, filed on Oct. 22, 1990, which was abandoned upon the filing hereof.

BACKGROUND OF THE INVENTION

The present invention relates to locksmith tools and particularly to an apparatus which is used so that the exact length of lock pins in a lock can be determined so that the right key can be made which will unlock the particular lock.

In the prior art, there are generally two ways of making keys for conventional locks. The first way is to duplicate the original key or a copy of it and then use it to lock or unlock a door (depending on what one wants to do each time).

The second way of making a key for a particular lock is to know the "code" of a given key. That means, one gives the key a number (a "code") which indicates the length of lock pins or locking elements in the lock. This number is often printed on the key cuts on the lock. Knowing the number of a particular key, another key can be made by duplicating the length of key cuts which correspond to the number of the lock, as mentioned above.

The present invention relates to this type of lock, but the way of making a key for a particular lock is different than the ones described above and particularly useful when the original key and the lock code are not available.

SUMMARY OF THE INVENTION

An apparatus for use in determining lengths of locking elements in locks having rotating pins extending in first cylinder and driver pins and compression springs, including: a head, a frame, at least one tube, a wire having an end extending through and movable within the tube to extend to press the rotating pin downwardly and the rotating pin presses the driver pin to compress the compression spring to its minimum length, the tubes being oriental to direct the end of said wire against the wall of a cylinder to urge the rotating pin of its periphery.

DETAILED DESCRIPTION OF THE PREFERRED EMBODIMENT

Figure 1:
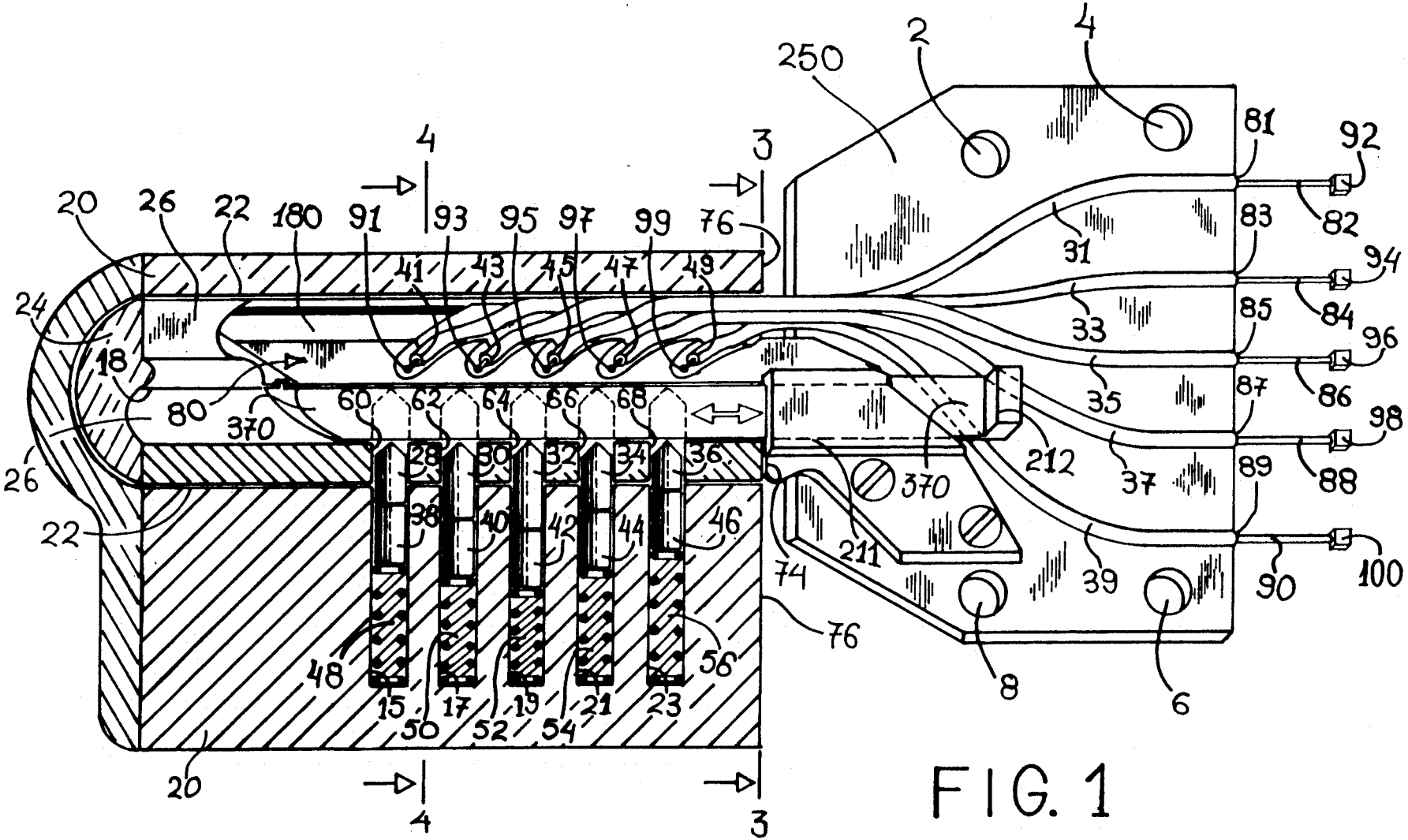
FIG. 1 is a partial sectional side view of a first portion of a tool according to a preferred embodiment of the present invention inserted into a conventional lock.
Figure 2:
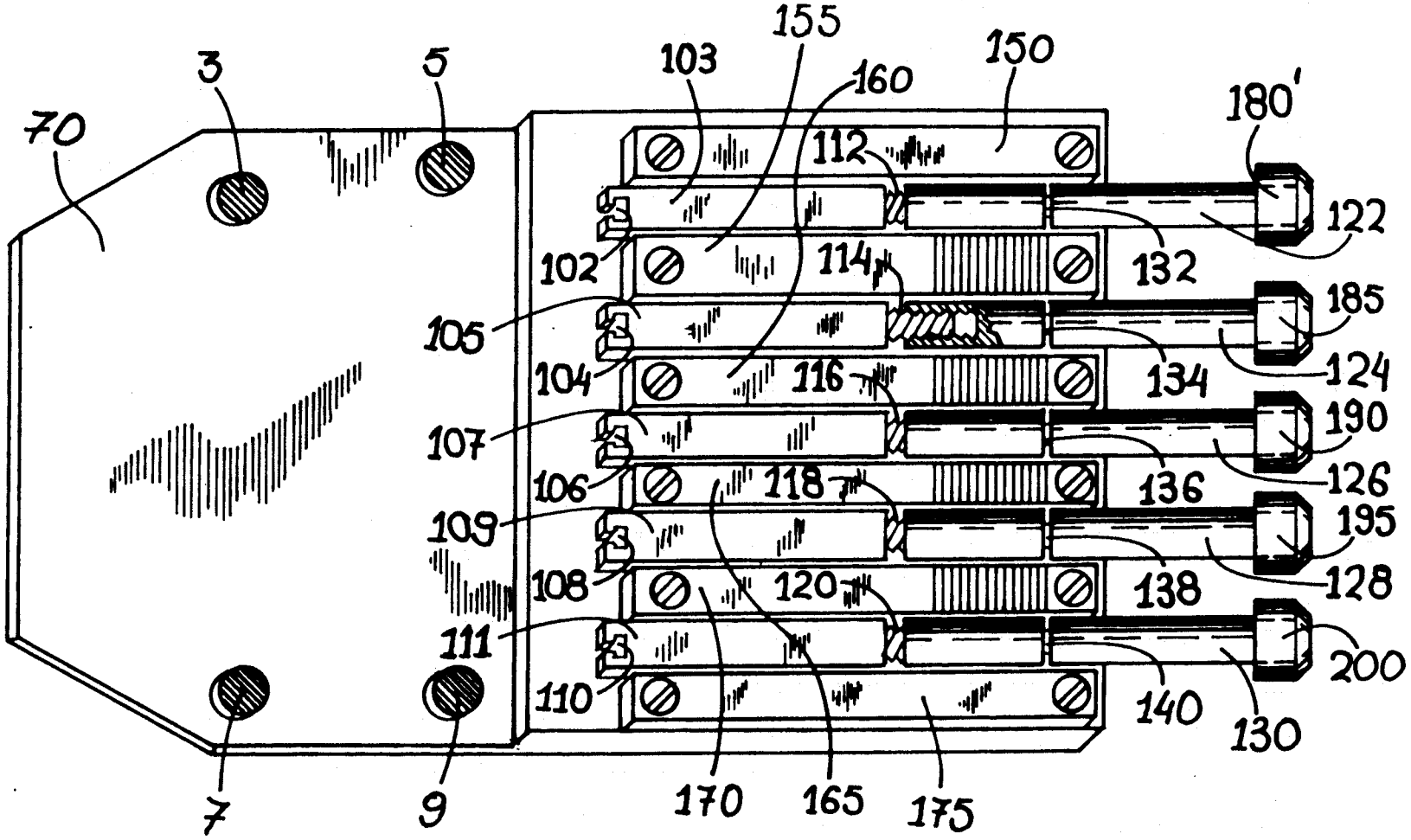
FIG. 2 is a side view of a second portion of the preferred embodiment of the present invention.

Refer now to FIG. 1, there being shown a first portion 250 of a preferred embodiment according to the present invention. FIG. 1 is a side view of the lock 20, a bore 22, a rotating part 24 which includes a keyway 26 and a part of a frame 250 and a head 80 which is in operating position.

A conventional lock 20 includes five small diameter cylinders 15, 17, 19, 21 and 23, which are aligned and spaced apart, substantially equally. The spaces between the first cylinders are of the same width as the spaces between a series of second cylinders of a rotating part 24 of the lock 20. The first lock cylinders of the lock 20 are located vertically to the lock 20.

Each of the five cylinders includes a compression spring and a driver pin. The cylinder 15 includes a compression spring 48 and a driver pin 38. The cylinder 17 includes a compression spring 50 and a driver pin 40. The cylinder 19 includes a compression spring 52 and a driver pin 42. The cylinder 21 includes a compression spring 54 and a driver pin 44. The cylinder 23 includes a compression spring 56 and a driver pin 46.

The lock 20 includes a bore 22. Within the bore 22 is positioned a rotating part 24 which is turned to lock or unlock the door or other closure to which the lock is connected. The rotating part 24 also includes five small diameter second cylinders 60, 62, 64, 66, 68 and a keyway 26.

Positioned respectively within the second cylinders 60, 62, 64, 66, 68 are the rotating pins 28, 30, 32, 34, 36. Each of the rotating pins is conical at corresponding points 16, as shown for pin 28 in FIG. 4, so that the rotating pins mate with the conical parts of the key. The compression springs urge the driver pins and the driver pins urge the rotating pins which are located within cylinder 15, cylinder, 17, cylinder 19, cylinder 21 and cylinder 23 and, consequently, the rotating pins are moved to be inserted to some extent into the cylinder 60, the cylinder 62, the cylinder 64, the cylinder 66, the cylinder 68, respectively, of the rotating part 24.

Each of the compression springs 48, 50, 52, 54 and 56 has the same length while uncompressed as the other compression springs when uncompressed. Moreover, when the compression springs are compressed to their minimum length, each has the same length as the others. Also each of the driver pins 38, 40, 42, 44 and 46 has the same length as the other driver pins. Knowing the length of the compression springs and the length of the driver pins, the only dimension that is left to find out is the length of the rotating pins 28, 30, 32, 34 and 36 which do not have the same length.

This difference in lengths of the rotating pins is compensated for by the key while located within the rotating part 24. That means, the longer the length of the rotating pin for each cylinder, the deeper the respective key cut, so that together they have a length corresponding to the dimension of bore 22. As soon as the rotating pins reach the bore 22, the rotating part of the lock may be rotated. Making a key having the right size cuts can be achieved by using the present invention which measures the length of the rotating pins 28, 30, 32, 34 and 36 which are located within the rotating part 24.

Above the frame 250 is a head 80 which is attached to it, and which is inserted in the keyway 26 and is in the form and shape of a key and covers the whole space 26 just as a key does.

The head 80 can be divided in two parallel parts: the upper part 180 which extends to the main cut 18 and the lower part 370 which is movable within a channel or slot 211 so that it may move rearwardly by pulling on the hook 212.

Figure 4:
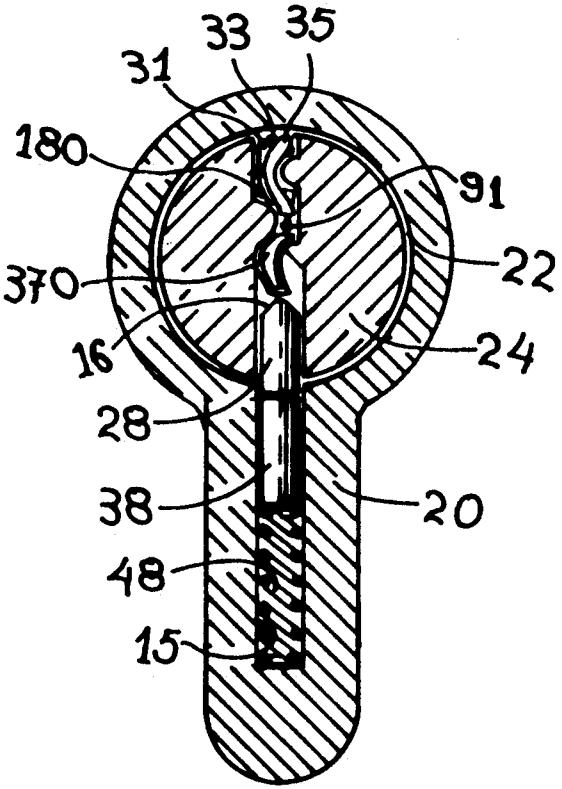
FIG. 4 is a view taken of a section line 4—4 of FIG. 1.
Figure 3:
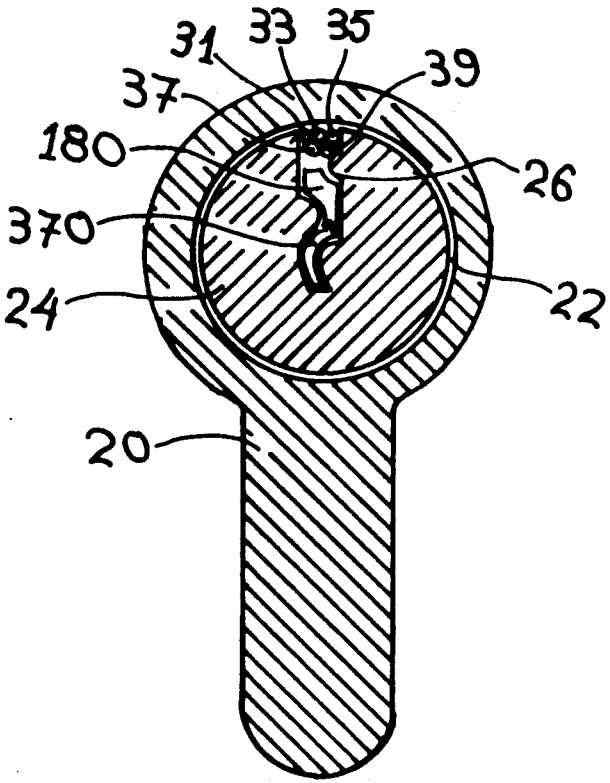
FIG. 3 is a view taken of a section line 3—3 of FIG. 1.
Figure 5:
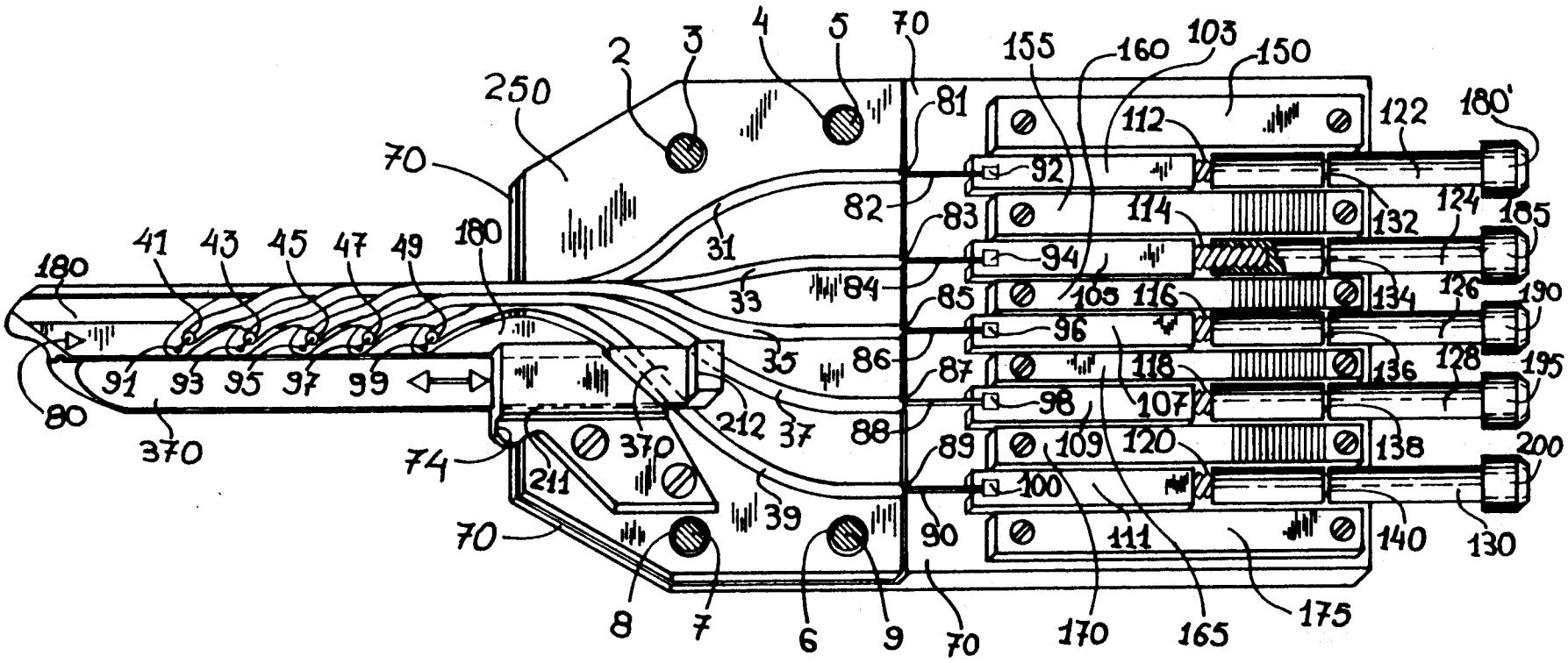
FIG. 5 is a side view showing the first portion of FIG. 1 joined to the second portion of FIG. 2.
Figure 6:
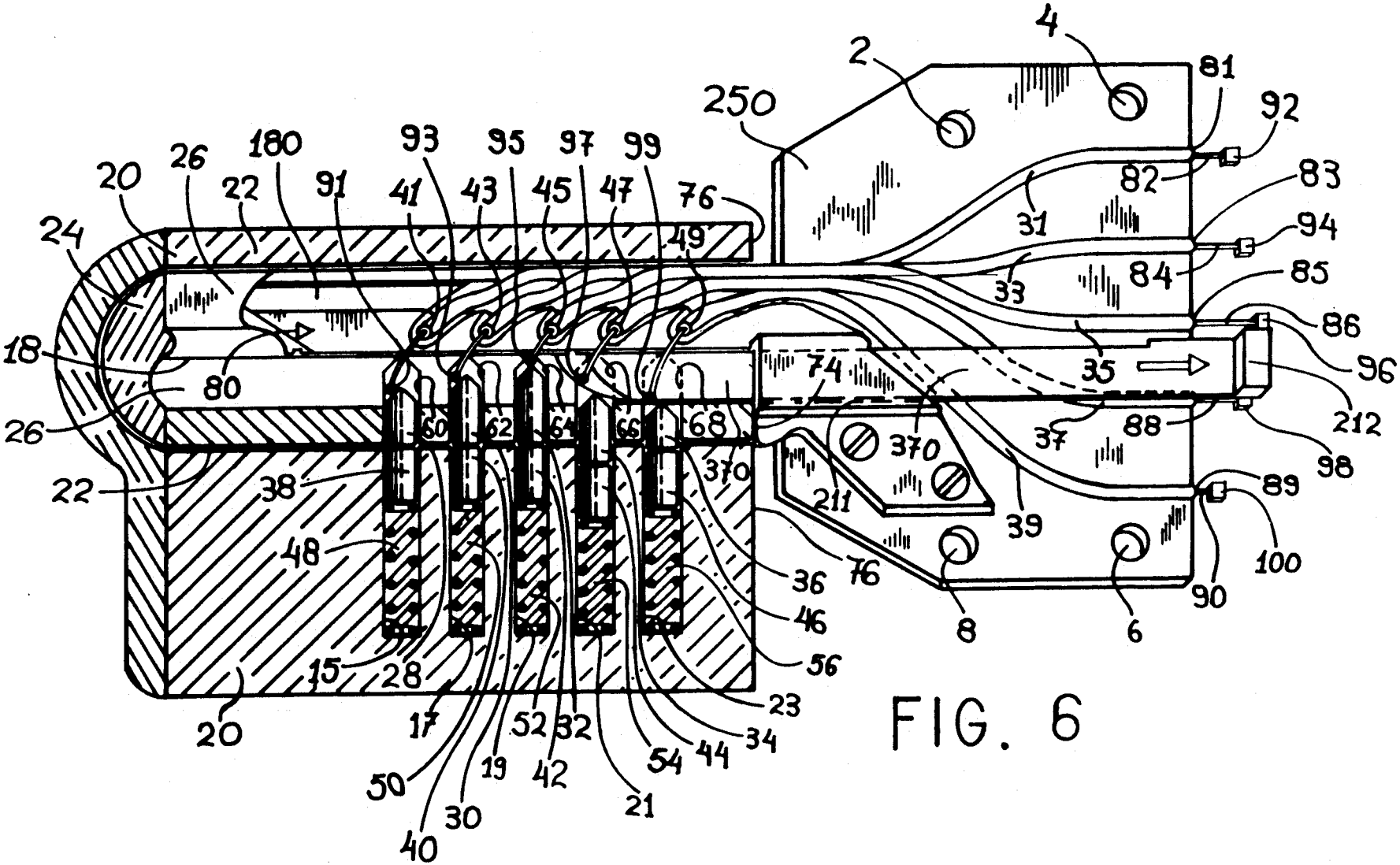
FIG. 6 is a view like FIG. 1 showing the part 370 in a retracted position.

Five small diameter tubes match with the head 80 and are located above it and they also extend within the cross section of a key, as shown in FIG. 4. The curves of these tubes are gradual so that the wires may be able to move within the tubes, without being altered in any way. Extending within the tubes are the wire 82, the wire 84, the wire 86, the wire 88 and the wire 90, as shown in FIG. 1.

These wires terminate a little further up from and do not extend into the main cut 18 of keyway 26. The wires extend from the points 41, 43, 45, 47 and 49, and conform with the form of the head 80. Then the wires continue to extend to and are attached to the frame 250 and terminate at the back of the frame 250 at the points 81, 83, 85, 87 and 89.

Within the tubes 31, 33, 35, 37 and 39 are positioned the wires 82, 84, 86, 88 and 90, respectively, which extend from the points 81, 83, 85, 87 and 89, respectively, through the tubes 31, 33, 35, 37 and 39, respectively, and terminate at the points 41, 43, 45, 47 and 49, respectively, at the front of the head 80. Each wire at one of its ends includes a small ball, sphere or circle. These are the circle 91, circle 93, circle 95, circle 97 and circle 99. The wires include the balls or circles at their ends so that the ends will slide up within and along the walls of the cylinders in order that they can be able to slope within the cylinders 60, 62, 64, 66, 68 in a consistent and repeatable manner to press the lower pins 28, 30, 32, 34, 36, respectively. This is advantageous because it is practically impossible to achieve the right pressure downwardly on the rotating fins by pushing the circles, or any other shaped tip, directly on the conical tips of the heads. The wires extend outwardly at the back of the frame 250 at the points 81, 83, 85, 87, 89 and have rectangular ends 92, 94, 96, 98, 100, respectively.

What is described so far is a part of the tool which may be specifically adapted, depending on the particular type of lock and shape of keyway one wants to lock or unlock. That means one may have at his disposal several heads which all match the lock type and keyway shape, and use the right one each time one wants to lock or unlock a lock. There are four holes 2, 4, 6 and 8 extending through the frame 250 in FIG. 1 into which extend the driver pins 3, 5, 7 and 9 of the mechanism 70. Upon positioning the driver pins 3, 5, 7 and 9 in the holes 2, 4, 6, 8, respectively, at the same time, the rectangular heads 92, 94, 96, 98 and 100 are positioned in the recesses 102, 104, 106, 108 and 110, respectively, so that they are connected with the rods 103, 105, 107, 109 and 111, respectively, which have threads 112, 114, 116, 118 and 120 at the back, on which the pins 122, 124, 126, 128 and 130 may screw. These pins have internal threads which screw on the rods 103, 104, 106, 108 and 110.

The pins 122, 124, 126, 128 and 130 each have one groove 132, 134, 136, 138 and 140, respectively. These grooves are called the counting sloping shoulders. The pins 122, 124, 126, 128 and 130 have buttons 180', 185, 190, 195 and 200, respectively, at the back, which the locksmith presses to move the pins. The grooves of these pins are initially adjusted to align with the counters 150, 155, 160, 165 and 170, at the right place each time as discussed below. The measurement of the position of the grooves may be achieved by any means, that is mechanically, electronically or by LCD.

In use of the invention, the first thing the locksmith does to determine the length of locking elements in a particular lock, is to find out the type of the lock in question. He then chooses the right head 80 to match the keyway and attaches the head 80 with the frame 250 to the mechanism 70.

The locksmith must have at his disposal various kinds of heads according to all kinds of locks which are on the market. All of the kinds of heads 80 fit on to and may be used with the mechanism 70. Then the head 80 is attached to the mechanism 70 at points 3, 5, 7 and 9. Next, the rectangular heads 92, 94, 96, 98 and 100 of the wires 82, 84, 86, 88 and 90 are connected at the points 102, 104, 106, 108 and 110 to the rods 103, 105, 107, 109 and 111 of the mechanism 70.

Then the locksmith adjusts at the counting points 150, 155, 160, 165 and 170, which are located at the back of the mechanism 70 by moving the grooves 132, 134, 136, 138 and 140, to correspond on each counting point to the display "0" (zero) on the counters 150, 155, 160, 165 and 170. This adjustment can be achieved by the rotating movement (left-right) of the pins 122, 124, 126, 128 and 130.

The locksmith then inserts the head 80 in the keyway 26 of the lock- 20. When the driver 74 contacts the front of the lock 76, the respective wire ends which are shaped into a small ball, sphere or circle (shown numbered as 91, 93, 95, 97 and 99) and extending from the tubes 31, 33, 35, 37 and 39, are disposed above the rotating pins 28, 30, 32, 34 and 36.

Next the locksmith presses the button 180', which then presses the pin 122, and this pin presses the rod 103 at which the rectangular head 92 of the wire 82 is attached, at the point 102.

As the locksmith presses this button towards the lock, the wire 82 is also pressed and it extends outwardly at the point 41, with its end 91, which is round, at the outer point of it. As this end 91 moves out, at the point 41, it contacts the cylinder 60 and extends into it sliding along its side. Then the end 91 presses the rotating pin 28 downwardly. But the end 91 is not pressing on the conical head, because this would yield it practically impossible to maintain alignment and thus predictable extension length, consistently and repeatedly. Rather, the end 91 presses the rotating pin nearer its circumference.

Then the rotating pin 28 presses the driver pin 38. The driver pin 38 presses the compression spring 48, to its minimum length. When this compression spring is compressed to its minimum length, the locksmith looks at the groove 132 of the pin 122, which corresponds to a number on the counter 150. This number corresponds to the length of one of the corresponding cuts of the particular key that is to be made to fit the lock. This process is repeated to determine the length of the rest of key cuts for the key. So the locksmith, knowing the length of key cuts of the particular key, he can easily make one, and he can lock or unlock the particular lock.

This invention, besides the use mentioned above, which is determining the length of locking elements in a particular lock and making the right key for it, can also be used directly to open a lock without first making a key. In this case, this apparatus operates as described below.

The head 80 of the mechanism can be divided in two parallel parts, the upper part 180, which is rigidly affixed to the frame 250, and the lower part 370, which is movable and is disposed within the canal ditch 211.

After completing the above-described procedure for determining lengths of locking elements in a particular lock, the locksmith knows the length of each rotating pin 28, 30, 32, 34, 36. These lengths correspond to numbers which are illustrated on a board which determines how far the ends (small ball) 91, 93, 95, 97 and 99 of the wires 82, 84, 86, 88 and 90 have to extend into the cylinders 60, 62, 64, 66 and 68.

When the wires extend into the cylinders to the lengths determined on the board, the locksmith pulls the lower part 370 of the head 80, by a hook 212, backwardly, until part 370 comes out of the lock 20. The upper part 180 of the head 80, however, remains within the lock 20. As soon as this happens, the compression springs 48, 50, 52, 54, 56 press the driver pins 38, 40, 42, 44, 46 upwardly. These driver pins then press the rotating pins 28, 30, 32, 34, 36, upwardly, as well. The rotating pins 28, 30, 32, 34, 36 stop when they contact the circle (small ball) ends 91, 93, 95, 97, 99 of the wires 82, 84, 86, 88, 90.

The locksmith then notices that the down part of each of the rotating pins 28, 38, 32, 34, 36 comes to the rotating point 22. The same thing happens with the driver pins 38, 40, 42, 44, 46, which also come to the same point, which is the rotating point 22.

As soon as the locksmith brings the driver pins 38, 40, 42, 44, 46 which remain within the lock 20, to the bore 22, and the rotating pins 28, 30, 32, 34, 36 which remain within the rotating part 24, also to the bore 22, he can then rotate the rotating part 24 to lock or unlock the lock.

What is claimed is:

1. A locksmith tool apparatus for decoding the length of a tumbler pin disposed in a discrete lock cylinder within a cylinder lock of the type having a lock housing with a rotatable lock cylinder therein, said apparatus comprising:

lock insertion means slidably insertable into a key way of the rotatable lock cylinder and including an upper portion and a slidable lower portion, said upper portion having a key shape, said key shape being uniquely defined by the shape of an upper portion of a key specific to the cylinder lock, said slidable lower portion when inserted into said key way being oriented to depress the tumbler pin to a fixed position within said discrete lock cylinder and in a direction away from said upper portion of said lock insertion means;

a frame uniquely attachable to said lock insertion means for controlling the distance said lock insertion means is to be slidably inserted into the key way such that a first end of a wire extending from a groove in said upper portion of said lock insertion means is oriented to extend in said direction away from said upper portion and downwardly along a forward wall within said discrete lock cylinder, said frame including means for supporting said slidable lower portion and permitting said slidable lower portion to be removed from the key way while the upper portion of said lock insertion means remains in the key way;

a small diameter fixed tube disposed within said groove for supporting said wire slidably driven therein, said small diameter fixed tube and said groove extending in a direction from said frame to said upper portion of said lock insertion means, said groove for guiding said small diameter tube to a position within said upper portion of said lock insertion means substantially over said discrete lock cylinder; and a universal adaptor for attaching to said frame, said universal adaptor comprising:

a wire depressing means attachably connected to a second end of said wire extending from said frame for slidably driving said wire through the small diameter fixed tube, the slidably driven wire depressing the tumbler pin from a fixed relative position below said slidable lower portion to a fully depressed position, said small diameter fixed tube being oriented such that the wire is guided to extend downwardly along said forward wall of the discrete lock cylinder thereby making contact with the tumbler pin therein at said fixed relative position;

means for measuring a maximum distance the wire is slidably extended downwardly by said wire depressing means;

means for calculating, in response to said measured maximum distance, a distance said tumbler pin must be extended downwardly from below said upper portion of said lock insertion means when said slidable lower portion is removed such that a bottom surface of said tumbler pin, resting on a driver pin within said discrete lock cylinder, is flush with the rotatable lock cylinder permitting the rotatable lock cylinder to rotate; and zeroing means connected to said wire depressing means and said measuring means for calibrating the measuring means by compensating for changes in wire elasticity or shifting of the small diameter fixed tube.

2. The locksmith tool apparatus of claim 1, wherein said groove forms a hollow path which traces the contour of the upper portion of said lock insertion means, and wherein the groove has a maximum feasible cross-sectional periphery at any point along said upper portion of said lock insertion means so as to minimize flexing of the small diameter fixed tube disposed therein.

3. The locksmith tool apparatus of claim 2, wherein said cylinder lock is of the type further having a plurality of additional tumbler pins and said apparatus comprises a plurality of additional wires arranged substantial parallel to said wire, each additional wire being assigned to decode a corresponding one of said additional tumbler pins, wherein said lock cylinder is opened in response to said apparatus depressing the tumbler pin and the additional tumbler pins to their a respective position which permits the rotatable lock cylinder to rotate.

4. The locksmith tool apparatus of claim 3, wherein said universal adaptor includes detachable means for connecting said wire and the additional wires extending from said frame onto said depressing means whereby said universal adaptor is used interchangeably with any one of a plurality of different frames, each different frame and lock insertion means attached thereto being unique to one of a plurality of rotatable lock cylinders.

5. The locksmith tool apparatus of claim 4, wherein said means for calculating displays the calculated distance for the tumbler pin and further displays a calculated distance for each of said additional tumbler pins thereby permitting a locksmith to create a duplicate key for use with the decoded cylinder lock.

* * * * *